United States Patent [19]

Junger et al.

[11] Patent Number: 4,483,482

[45] Date of Patent: Nov. 20, 1984

[54] DUAL-MATERIAL ATOMIZING NOZZLE

[75] Inventors: Martin Junger, Grafenberg; Wolfgang Nieuwkamp, Kappishausern, both of Fed. Rep. of Germany

[73] Assignee: Lechler GmbH & Co., KG, Fellbach, Fed. Rep. of Germany

[21] Appl. No.: 344,941

[22] Filed: Feb. 2, 1982

[30] Foreign Application Priority Data

Feb. 25, 1981 [DE] Fed. Rep. of Germany ..... 3106962

[51] Int. Cl.[3] ..... B05B 17/06

[52] U.S. Cl. ..... 239/434; 239/102; 239/424

[58] Field of Search ..... 239/432, 428, 427.3, 239/427.5, 589, 532, 102, 424, 453, 434

[56] References Cited

U.S. PATENT DOCUMENTS

| | | | |
|---|---|---|---|
| 2,543,996 | 3/1951 | Turner | 239/453 |
| 3,517,886 | 6/1970 | Dyck | 239/518 |
| 3,741,484 | 6/1973 | Cresswell | 239/102 X |
| 4,109,862 | 8/1978 | Hughes | 239/102 |
| 4,284,590 | 8/1981 | DeBoer et al. | 239/434 X |
| 4,361,285 | 11/1982 | Koppehele et al. | 239/424 |

*Primary Examiner*—John J. Love

*Attorney, Agent, or Firm*—Shlesinger Arkwright Garvey & Fado

[57] ABSTRACT

A dual-material atomizing nozzle comprises a housing (10) with a gas intake (13), a liquid intake (14) and with a mixing chamber (11) for the gaseous and liquid components; a rod-like insert (16) flaring into a saucer-shape opposite the nozzle exit extends through the mixing chamber (11) along its longitudinal axis (15); the end of the housing (10) which is at the nozzle exit side is thus covered while forming an approximately radial, annular-gap shaped nozzle exit slot (23).

At least one convergent/divergent tube-path (28, 29; 25, 24) based on the Laval principle is provided within the mixing chamber (11) no farther than the nozzle exit (12). Thereby, and especially when a second convergent/divergent tube path (25, 24) is present behind the liquid intake (14), first the gas and also the mixture of gas and liquid will be accelerated within the nozzle housing (10) to supersonic speed. In this manner a dual-material atomizing nozzle is created with an adequately large angle of jet and providing fine droplets, being insensitive to soiling and requiring only a slight ratio of gas to liquid, being resistant to wear and clogging.

13 Claims, 7 Drawing Figures

DUAL-MATERIAL ATOMIZING NOZZLE

The invention concerns a dual-material atomizing nozzle, in particular for the treatment and/or cooling of waste gases in waste incineration plants, comprising a housing supplied on one hand with the liquid to be atomized (for instance water) and on the other hand with the gas (for instance air) implementing the atomization, one or more inserts to guide and mix the gas and/or the mixture of gas and liquid, being arranged in the housing.

Nozzles of the above cited type are frequently used in cooling towers when treating the waste gases in waste or trash incineration plants. Other fields of application obviously are equally conceivable. The dual-material atomizing nozzles when used in the initially cited fields of application serve in particular for injecting water, which may also contain soda lye, or milk of lime to neutralize hydrochloric acid in the waste gas, with cooling of the waste gas talking place at the same time.

It is known in regard to the cited purposes to make use of dual-material hollow or solid cones with a jet angle up to about 60°. The German Offenlegungsschrift No. 26 27 880 has disclosed dual-material nozzles atomizing by means of a discrete increase in pressure at the nozzle exit the mixture of air and water issuing at the speed of sound. Similar atomizing nozzles operating on the Laval (supersonic) principle for a mixture of air and water are known from German Auslegeschrift No. 28 43 408. The significant drawback of these known dual-material atomizing nozzles must be deemed to be the very small jet angle. Specifically, the following difficulties are encountered:

As regards the initially cited fields of application, the atomizing nozzles typically are integrated to be atomizing upwards, whereas the gas to be treated, for instance a waste gas, flows from top to bottom. The liquid droplets however fall back in part on the nozzle; that is, the gas with its ingredients hits the sides of the nozzle. Depending on the ingredients in the gas, caking takes place, whereby the mixing is hampered, often even prevented, where nozzles with external gas and water mixing are involved.

As regards the conical jets in the known dual-material atomizing nozzles, the drops within the cone make little contact, or none at all, with the gas to be treated, with the ensuing drawbacks that there is inadequate scrubbing, or cooling, or chemical reaction of the gas to be treated.

A primary object of the present invention is to provide a nozzle of the type initially cited which evinces a sufficiently large angle of jet, provides fine drops, is insensitive to soiling, requires only a slight ratio of gas to liquid, is resistant to wear and insensitive to clogging.

This problem is solved by the invention which thereby eliminates the drawbacks cited in that the essentially or substantially cylindrical housing comprises a mixing zone from the gaseous and liquid components, with a rod-like insert passing through the mixing chamber along the longitudinal axis and flaring like a saucer opposite the nozzle exit in such a manner that it covers the housing end at the nozzle exit side while forming an approximately radial nozzle exit slot in the shape of an annular gap, and in that within the mixing chamber one or more convergent-divergent tube paths designed on the Laval principle are provided at the latest before the nozzle exit is reached.

One substantial advantage of the invention is that an essentially finer atomization of the liquid is obtained for a lesser consumption in gas. The mixing chamber within the elongated housing prevents delaying the mixing of the two media until beyond the nozzle exit. The rod-like insert with saucer-ending makes possible very fine atomization at maximum jet angles (up to a radially circular jet). This means on one hand that there will be a uniform coverage of the total flue cross-section (when treating waste gases in trash incineration plants) by the liquid jet, so that a quick and controlled exchange with the gas is achieved. The radial atomization of the invention with the good contact between the droplets and the waste gas prevents unilateral accumulations of droplets in particular regions of the gas flow. Rather, the liquid droplets are distributed uniformly in the dual-material atomizing nozzle of the invention. This permits a quick, intensive and uniform treatment or cooling of the waste gas. On the other hand, the radial or nearly radial jet from the nozzle of the invention is advantageous in that the nozzle is not susceptible to soiling and clogging because the droplets falling back on the nozzle exit cannot clog the radially terminating nozzle aperture. The nozzle of the invention moreover operates at low wear, and this is especially advantageous if henceforth milk of lime rather than soda lye as to-date is added to the liquid. Milk of lime per se is a wear-inducing medium because containing small crystalline particles acting in grinding manner. The smooth and rounded-off surfaces of the nozzle of the invention act in wear-reducing manner in this respect.

Another substantial advantage of the nozzle of the invention is that it can be manufactured in a single operational stage as a whole, that is, the housing together with the rod-like insert including the saucer-like flared part, for instance on numerically controlled timing machines. This simple manufacture offers appreciable savings.

The invention is discussed more comprehensively below in relation to the illustrative embodiments shown in the drawings in which.

Figure 1:
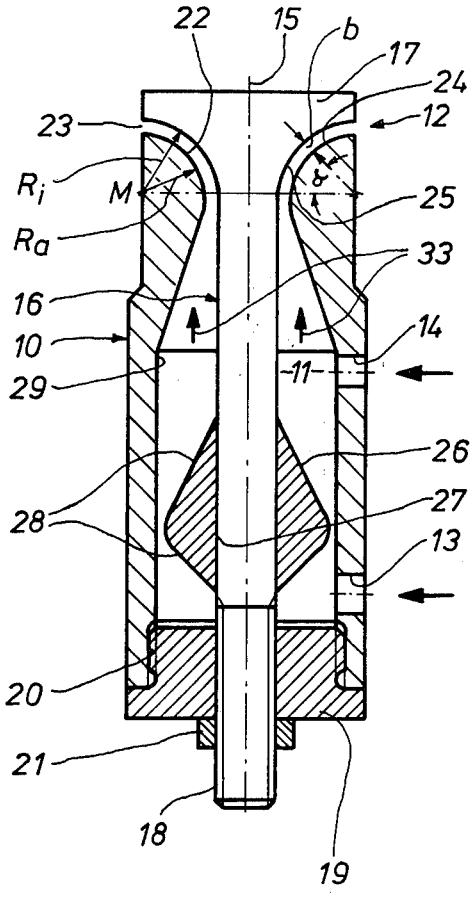
FIG. 1 is a longitudinal section of an embodiment of a dual-material atomizing nozzle.
Figure 2:
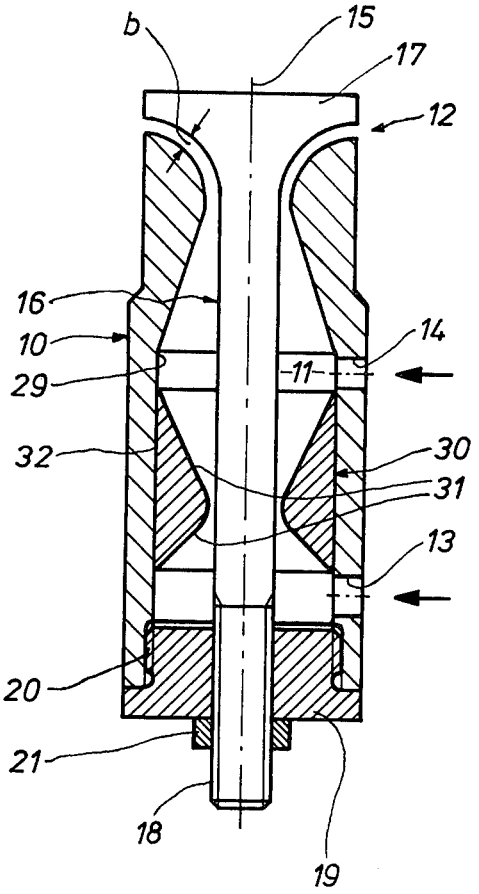
FIG. 2 is a longitudinal sectional view of another embodiment of a dual-material nozzle.

As shown in FIGS. 1 and 2, the reference 10 denotes the cylindrical housing of a dual-material atomizing nozzle. The housing 10 comprises on its inside a cavity 11 which initially is also cylindrical but which tapers conically toward the nozzle exit 12. The cavity 11 acts as the mixing chamber for the two components fed into the nozzle, one of which is gaseous and the other liquid, for instance air and water. The gaseous component, for instance air, is fed at 13 into the mixing chamber 11, whereas the liquid component, for instance water, is supplied at 14. As further shown by the FIGS. 1 and 2, a rod-like insert 16 passes centrally through the housing 10, that is coaxially with the housing's center axis 15, said insert flaring into a saucer-shape at its nozzle-side end 17 and thereby covers frontally the end of the nozzle exit 12. The rod-like insert 16 is provided with a thread 18 at its rear end and is fixed by said thread to a nut 19. The nut 19 is screwed at 20 to the housing 10 and at the same time forms a lid-like rear termination means for the housing 10.

A lock nut 21 is screwed on the thread 18 at the rear end of the rod-like insert.

Figure 6:
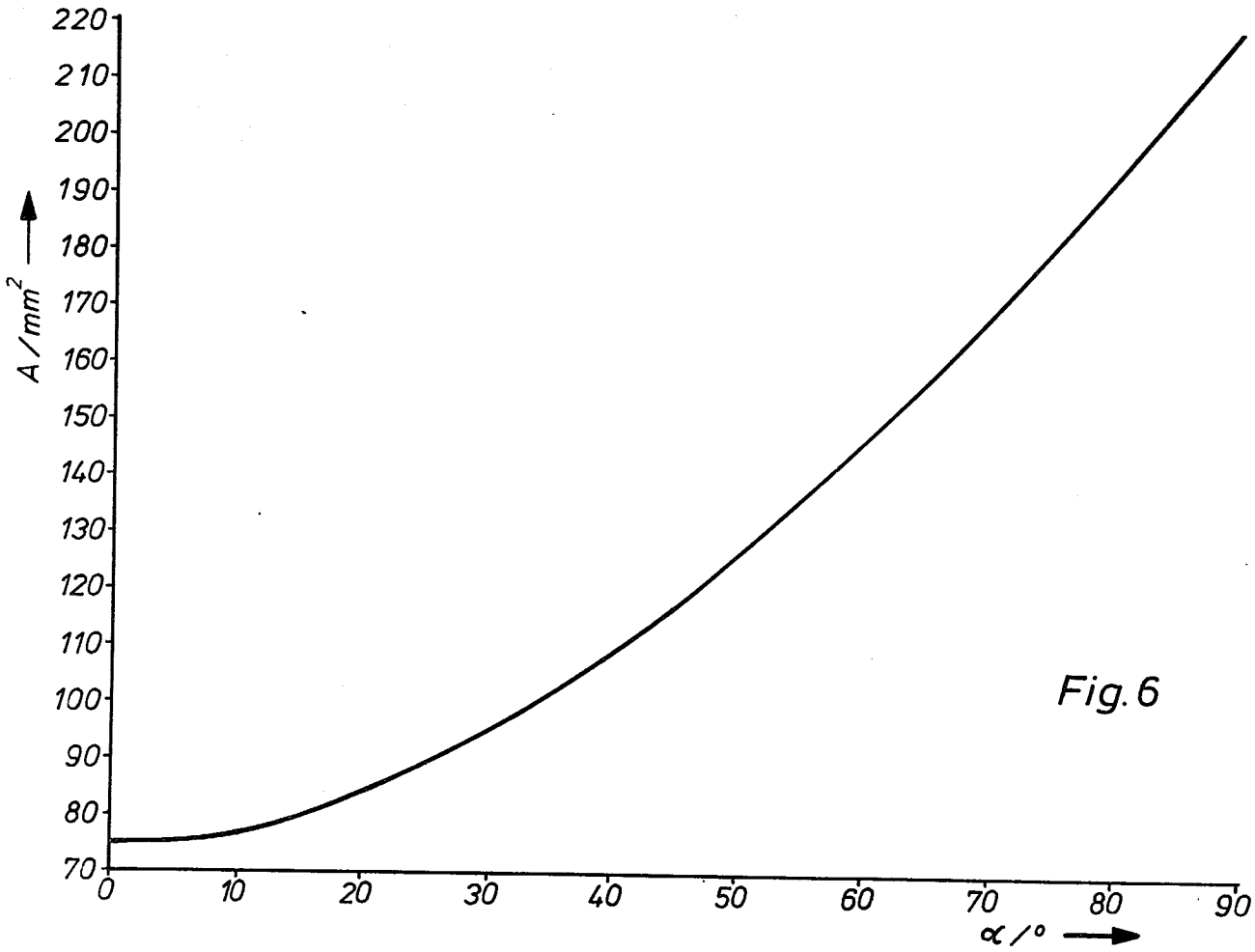
FIG. 6 is a plot corresponding to FIG. 5 for nozzle exit according to the embodiment of FIG. 1 and 2.

FIG. 1 further shows that the embodiments of FIGS. 1 and 2, the geometry of the nozzle exit 12 is in the form of a quarter-circle deflection zone 22 as seen in longitudinal section, which issues into the nozzle exit slot proper denoted by 23 and pointing radially. The longitudinal quarter-circle deflection zone 22 is circular in cross-section and in this case is formed by a surface 24 curved into an arc of circle and with a radius $R_a$ in the nozzle housing 10, and by another surface 25 also curved into an arc of circle with a radius $R_i$ in the rod-like insert 16. The two radii of curvature $R_a$ and $R_i$ have a common origin M whereby the inside width of the nozzle exit 12, including the entire deflection zone 22, will be constant over the entire angle of deflection from alpha=0 to alpha=90°. Obviously the flow cross-section A of the deflection zone 22 varies as a function of the angle of deflection alpha as far as the nozzle exit slop proper 23, that is, it enlarges uniformly to a maximum. This functionality is shown in the plot of the FIG. 6.

The embodiment shown in the FIG. 1 comprises in the rear part of the mixing zone 11 (that is the lower part of the drawing) an insert 26 of double cross-sectionally conical shape and with symmetry of revolution. This insert 26 is provided with a central bore 27 by means of which it is fastened, for instance by heat-shrinking, on the rod-like insert 16. Due to the doubly conical peripheral surface 28 of the symmetry-of-revolution, insert 26 on one hand and the inside wall 29 of the housing 10 or the mixing chamber 11 on the other, there is thusly achieved a convergent/divergent tube path of the Laval principle in the region cited, through which the gaseous medium supplied at 13 will be accelerated to supersonic speeds, that is in excess of about 340 m/s.

Another variation for generating supersonic gas flow is shown in FIG. 2. in this case too, an insert 30 with symmetry of revolution is arranged within the mixing chamber 11 which however differs from the insert 26 of FIG. 1 in being designed itself as a Laval nozzle. The Laval-nozzle shaped flow channel, which is also symmetrical in revolution, of the insert 30, is denoted by 31. The insert 30 is shaped cylindrically at its outer surface 32 and with a diameter corresponding to the inside diameter of the mixing chamber 11 and is fixed to the inside wall 29 of the mixing chamber 11. The Laval-nozzle shaped inside 31 of the insert 30 is traversed by the rod-like insert 16. In this embodiment too one obtains a convergent/divergent tube path according to the Laval principle and through which the gaseous medium within the mixing chamber 11 will be accelerated to supersonic speed.

After the liquid component is introduced at 14, both embodiments will accordingly have supersonic speeds (exceeding 30–60 m/s) for the mixture of gas and liquid at the nozzle exit slot 23 (FIGS. 1 and 2).

However the invention is in no way limited to the quarter-circle design of the deflection zone 22–24 to the nozzle exit slot 23 shown in FIGS. 1 and 2. Instead, and depending on the particular application, smaller or larger angles of deflection than 90° are also conceivable. (In the case of alpha larger or less than 90°, a hollow cone jet would be obtained for instance). Also, the deflection surfaces 24, 25 may be different, that is, they may deviate from the arc-of-circle shape shown in longitudinal section in FIGS. 1 and 2, that is, they may curve differently. The surfaces 24, 25 conceivably can also be ellipsoids, hyperboloids, paraboloids of revolutions etc. The arc-of-circle form of the embodiments as selected in FIGS. 1 and 2 (as seen in longitudinal section) however is especially advantageous in manufacture.

Figure 3:
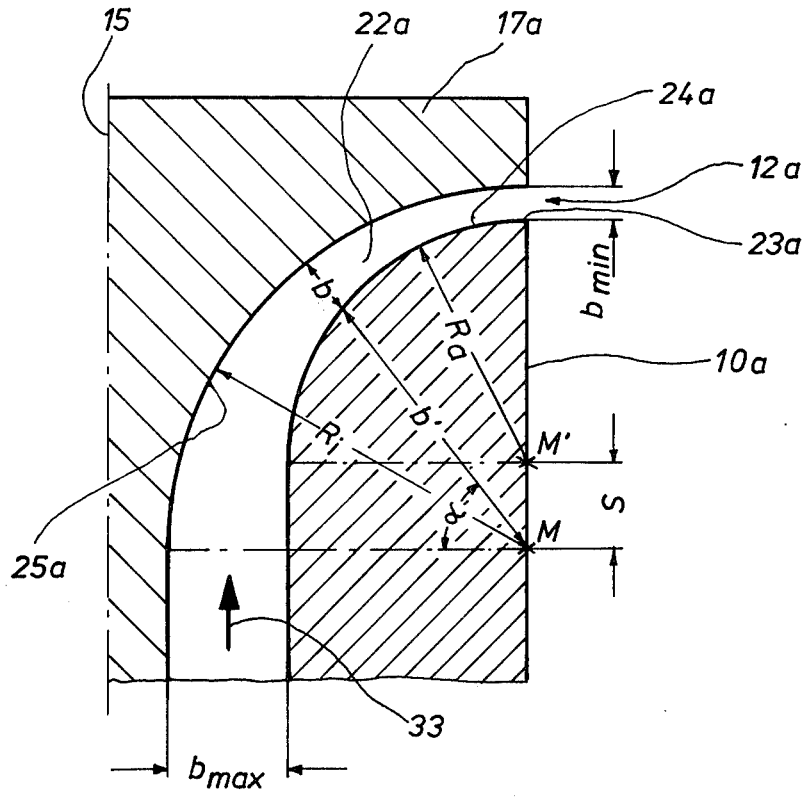
FIG. 3 is a partial longitudinal section of the nozzle exit of a dual-material atomizing nozzle.
Figure 5:
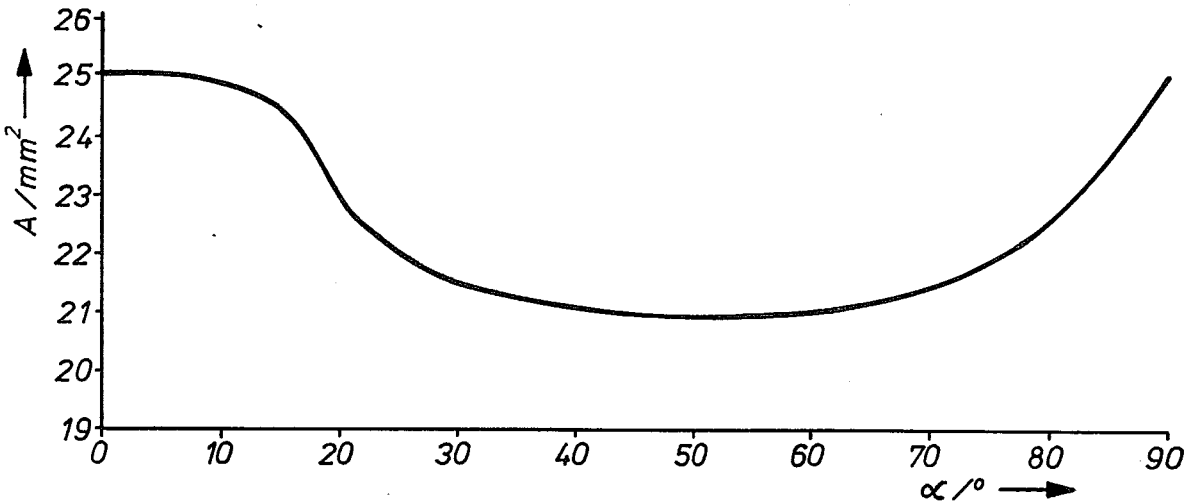
FIG. 5 is a plot of the flow cross-section in the deflection region of the nozzle exit, shown as a function of the particular angle of the deflection $\alpha$ ranging from 0° to 90° and according to an embodiment of FIG. 3.

FIG. 3 shows an embodiment wherein, just as in FIGS. 1 and 2, the two surfaces **24*a*, 25*a* of the housing 10*a* and of the saucer 17*a* forming the deflection zone 22*a* and the radially directed nozzle exit 12*a* each are in quarter-circle shape (as seen in longitudinal section). Again the centers of curvature of the surfaces 24*a*, 25*a* also each are on the surface of the housing 10 as for the FIGS. 1 and 2. On the other hand, however, differing from the embodiments of the FIGS. 1 and 2, the two quarter-circles of radii $R_a$ and $R_i$ do not have a common origin. Rather the two oirgins M and M' are offset mutually by an amount S in the direction of the longitudinal axis 15 of the housing 10. As a result the inside width of the delfection zone 22*a* drops in the direction of flow (arrow 33) from $b_{max}$ at the beginning of the deflection to $b_{min}$ directly before the exit slot 23*a*. If on the other hand the cross-section of the annular channel forming the deflection surface 22*a* is considered as a function of the angle of defelction alpha (0° to 90°), then, as clearly shown by FIG. 5, a cross-sectional minimum takes place near alpha=50°. In this manner the embodiment of the FIG. 3 makes it possible to achieve the Laval effect without additional steps, that is, without requiring the specific integration of convergent/divergent tube paths (as in FIGS. 1 and 2**) for the purpose of obtaining fine atomization.

Figure 4:
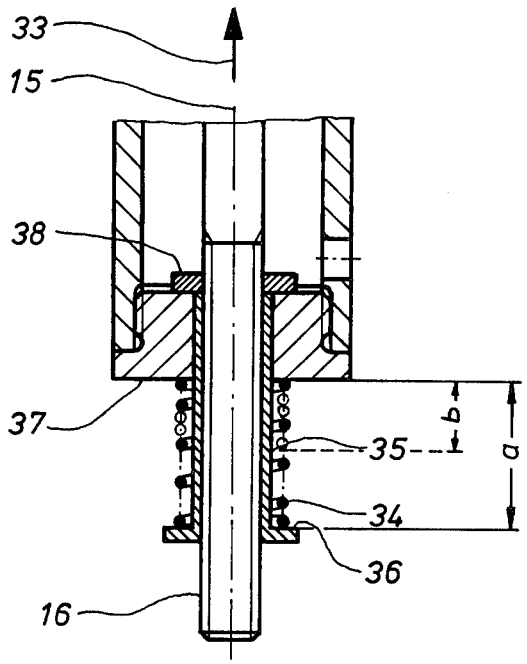
FIG. 4 is a longitudinal section of an applicable manual and/or automatic adjustment means for the nozzle exit.

FIG. 4 shows one approach in varying the geometric relations in the deflection zone 22, **22*a* or at the nozzle exit 12, 12*a* in simple manner by varying the offset S of the centers of curvature. The rod-like insert 16 is designed for that purpose to be adjustable (or settable) in the direction of its longitudinal axis 15. The actuation, for instance manual, of the rod-like insert 16 in the direction of flow 33 is implemented against the resistance of a compression spring 34 surrounding a sliding sleeve 35 and resting axially against two surfaces 36,37. The arrangement shown in FIG. 4 results in a maximum adjustment path characterized by $a-b=c$. This adjustment path is bounded on one hand by the compression spring 34 when compressed to a solid length b and on the other hand by a stop 38. The longitudinal setting of the rod-like insert 16 on one hand can be advantageously used for cleaning the nozzle exit. On the other hand the setting latitude of the rod-like insert 16** might be automated, for instance as a function of the nozzle flow rate, in order to achieve in this manner optimal spraying profiles (achieving supersonic speed of the liquid-gas mixture over a wide operational range).

Figure 7:
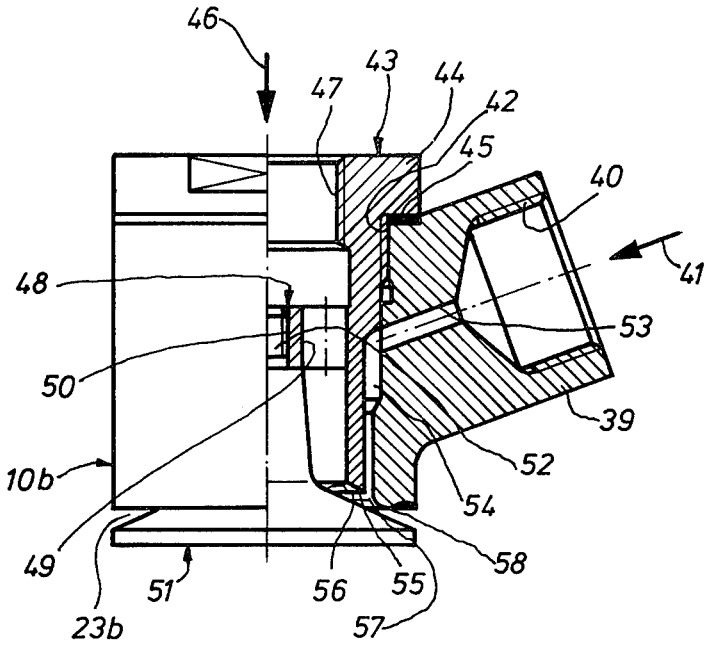
FIG. 7 is another embodiment of a dual-material atomizing nozzle, half in longitudinal section and half in front view.

FIG. 7 shows another very advantageous embodiment of a dual-material atomizing nozzle. Herein **10*b*** denotes the nozzle housing comprising a laterally integrally cast nipple 39 for the liquid intake. The nipple 39 is provided with an inside thread 40 for connection to a corresponding liquid feed line (omitted). The liquid feed takes place in the direction of the arrow 41.

The nozzle housing **10*b* is provided at its rear end with an inside thread 42 receiving an insert denoted by 43. The insert 43 is centered by means of a collar 44 in the nozzle housing 10*b* and sealed with respect to this housing by means of a conventional copper gasket 45 of rectangular cross-section. The compressed gas is fed in the direction of the arrow 46. The insert 43 is provided at its rear end with an inside thread 47** to receive the connector of a corresponding gas intake line (omitted).

As further shown in FIG. 7, the insert 43 comprises in its central region a partition 48 perforated by several coaxially directed bores arranged one behind the other in the circumferential direction. One of these axial boreholes is shown in FIG. 7 and denoted by 49. The partition 48 also is provided at its center with a threaded bore 50. The thread of the bore 50 is provided with a precise fit. A disk 51 is screwed by means of a suitably threaded pin 52 into the threaded bore 50. Again this is a close fitted thread. In this manner a precise centering of the disk 51 in the nozzle housing **10*b*, i.e. in the insert 43** is ensured.

The liquid supplied in the direction of the arrow 41 flows through the integrally cast nipple 39 and arrives at the front end of an intake bore 53 in an annular channel 54 bounded inside by the outer wall of the insert 43 and outside by the inside wall of the nozzle housing **10*b*. The gaseous medium, for instance compressed air, flows in parallel but initially still separately from the liquid medium in the direction of the arrow 46 through the inside chamber of the insert 43 as far as its forward, bevelled end 55. At this place there is a convergent-divergent annular channel for the gaseous medium, said channel being bounded on the outside by the bevel 55 of the insert 43 and on the inside by the bevel 56 of the disk 51. The gaseous medium accelerated within the annular channel 55,56 to supersonic speed then is combined at 57 with the liquid medium flowing through the annular channel 54 in the axial direction 46. The mixture lastly enters the outside through the nozzle exit slot 23*b* which also represents a convergent-divergent path and which is formed on one hand by the forward termination 58 of the nozzle housing 10*b* and on the other hand by the bevel 56 of the disk 51. This geometry of the nozzle exit slot 23*b*** ensures that the mixture of liquid and gas leaving the nozzle also will be at supersonic speed.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

We claim:

1. A supersonic nozzle for atomizing liquid and gas components, comprising:

(a) a housing have an axially extending bore with an open end and a closed end;

(b) said open end having a continuous non-interrupted inner surface including a generally radially outwardly flaring portion;

(c) said bore including a generally cylindrical portion and a frusto-conical portion connecting said cylindrical portion with said open end and said frusto-conical portion defining a mixing chamber and said frusto-conical portion having an apex adjcent said open end and from which said outwardly flaring portion extends;

(d) a gas inlet generally adjacent said closed end;

(e) a liquid inlet spaced adjacent the area connecting said frusto-conical portion and said cylindrical portion;

(f) an insert coaxial with said bore extending from said closed end to said open end and including a continuous non-interrupted outer surface generally corresponding to and aligned with said open end inner surface and providing a generally radially flaring terminal portion cooperating with said open end radially flaring portion and spaced therefrom and defining a substantially radially directed annular gap discharge for said bore;

(g) said insert cooperating with said frusto-conical portion for providing a flow channel adapted for accelerating a gas-liquid mixture to superson speeds; and, (h) a convergent-divergent restrictor member disposed about said insert and positioned in said bore between said gas inlet and said liquid inlet and defining a Laval principle flow channel for accelerating a gas to supersonic speeds whereby said accelerated gas mixes with a liquid in said frusto-conical mixing chamber and the mixture thereof is accelerated to supersonic speeds and discharges substantially radially through said annular gap at supersonic speeds.

2. A nozzle as defined in claim 1, wherein:

(a) said member being coaxially mounted to said insert;

(b) said member comprising;

i. a double frustum of cone with each frustum having an apex;

ii. each frustum having a base and with said bases being adjacent each other whereby said apexes are opposed from each other;

iii. a rounded transition zone associated with said bases; and iv. said flow channel being disposed between said member and an interior wall of said bore.

3. A nozzle as defined in claim 1, wherein:

(a) said member being generally cylindrical in shape and having an external diameter substantially equal to said bore diameter;

(b) said flow channel being coaxial with said bore; and, (c) said insert extending through said flow channel and having a diameter less than said flow channel diameter.

4. A nozzle as described in claim 1, 2 or 3, wherein:

(a) said open end radially flaring portion including a constant radius curved deflecting surface.

5. A nozzle as defined in claim 4, wherein:

(a) said insert radially flaring portion including a constant radius curved surface.

6. A nozzle as defined in claim 5, wherein:

(a) said open end curved deflecting surface and said insert curved surface having an angle of curvature of at least 30°.

7. A nozzle as defined in claim 6, wherein:

(a) said open end curved deflecting surface and said insert curved surface having coincidental radii of generation whereby said annular gap discharge having constant spacing.

8. A nozzle as defined in claim 7, wherein:

(a) said open end curved surface and said insert curved surface extending substantially 90°.

9. A nozzle as defined in claim 6, wherein:

(a) said open end curved deflecting surface and said insert curved surface having non-coincidental radii of generation; and, (b) said radii of generation being longitudinally offset from each other whereby said annular gap discharge has decreasing spacing.

10. A nozzle as defined in claim 7, wherein:

(a) said radii of generation being located on an outer surface of said housing.

11. A nozzle as defined in claim 1, 2 or 3 further comprising:

(a) a coaxial extension secured to said insert;

(b) a support coaxial with said insert extension and including a coaxial aperture whereby said insert extension extends through and is secured within said aperture;

(c) a spring coaxially mounted to said support and adapted for longitudinally displacing said insert; and (d) said insert being longitudinally adjustable against said spring.

12. A nozzle and defined in claim 11, wherein:

(a) said insert being automatically adjustable as a function of flow rate.

13. A nozzle as defined in claim 9, wherein:

(a) said radii of generation being located on outer surface of said housing.

* * * * *